US011325766B2

(12) United States Patent
Chen

(10) Patent No.: US 11,325,766 B2
(45) Date of Patent: May 10, 2022

(54) ROTARY BOTTLE WITH REPLACEABLE INNER CONTAINER

(71) Applicant: YUYAO CAIYUN COSMETICS PACKAGING CO. LTD., Zhejiang (CN)

(72) Inventor: Jiabin Chen, Zhejiang (CN)

(73) Assignee: YUYAO CAIYUN COSMETICS PACKAGING CO. LTD., Zhejiang (CN)

( * ) Notice: Subject to any disclaimer, the term of this patent is extended or adjusted under 35 U.S.C. 154(b) by 0 days.

(21) Appl. No.: 16/858,224

(22) Filed: Apr. 24, 2020

(65) Prior Publication Data

US 2021/0061533 A1 Mar. 4, 2021

(30) Foreign Application Priority Data

Aug. 30, 2019 (CN) ..... 201921433178.X

(51) Int. Cl.

| | |
|---|---|
| ***B65D 77/04*** | (2006.01) |
| ***B65D 21/02*** | (2006.01) |
| ***B65D 83/00*** | (2006.01) |
| ***A45D 40/04*** | (2006.01) |

(52) U.S. Cl.

CPC ..... *B65D 77/0453* (2013.01); *A45D 40/04* (2013.01); *B65D 21/0233* (2013.01); *B65D 83/0011* (2013.01)

(58) Field of Classification Search

CPC ..... B65D 77/0453; B65D 11/06; B65D 83/0005; B65D 83/0011; B65D 83/0016; B65D 83/0022; B65D 83/0027; B65D 83/0033; A45D 40/04; A45D 40/065; A45D 40/16; A45D 40/06

USPC ..... 220/23.87; 222/167, 383.2, 519, 520, 222/522, 548

See application file for complete search history.

(56) References Cited

U.S. PATENT DOCUMENTS

| | | | | |
|---|---|---|---|---|
| 4,984,718 A * | 1/1991 | Cardia | A45D 40/04 | 222/390 |
| 5,000,600 A * | 3/1991 | Cardia | A45D 40/04 | 222/390 |
| 5,016,782 A * | 5/1991 | Pfanstiel | A47K 5/1201 | 222/257 |
| 9,554,636 B1 * | 1/2017 | Piscopo | A45D 40/06 | |
| 2002/0025211 A1 * | 2/2002 | Gueret | B65D 83/0011 | 401/130 |

(Continued)

*Primary Examiner* — Robert Poon

(74) *Attorney, Agent, or Firm* — Muncy, Geissler, Olds & Lowe, P.C.

(57) ABSTRACT

A rotary bottle with replaceable inner container includes an outer bottle, an inner container and a rotating base, an inner cover installed above the inner container, a clamping point protruding outwards provided in an outer wall position of the inner container and correspondingly clamped in a groove at an inner wall of the outer bottle. A screw is provided in the inner position of the inner container, and an upper clamping ring connected with the inner container is provide in a position, close to a circumferential edge, and of an upper surface of a bottom of the screw. The inner container can be removed after use with a reusing function of an outer bottle remained, so as to reduce pollution to the environment, optimize a structure of the product, and reduce loss in a component.

9 Claims, 5 Drawing Sheets

(56) References Cited

U.S. PATENT DOCUMENTS

| | | | | |
|---|---|---|---|---|
| 2004/0206783 | A1* | 10/2004 | Danne | B65D 83/0011 222/390 |
| 2005/0178796 | A1* | 8/2005 | Shraiber | B65D 83/0011 222/78 |
| 2009/0324317 | A1* | 12/2009 | Batchelor | A61K 8/361 401/68 |
| 2009/0324321 | A1* | 12/2009 | Nasu | B65D 83/0011 401/172 |
| 2016/0029771 | A1* | 2/2016 | Walling | B65D 83/0011 220/23.91 |
| 2018/0086542 | A1* | 3/2018 | Ellsworth | A45D 34/04 |
| 2019/0133298 | A1* | 5/2019 | Bushell | A45D 40/04 |

* cited by examiner

ROTARY BOTTLE WITH REPLACEABLE INNER CONTAINER

FIELD

The invention relates to a technical field of rotary bottle, in particular, to a rotary bottle with a replaceable inner container.

BACKGROUND

At present, the rotary bottle available on the market comprises a body at a bottom of which a hollow rotating base is provided, and a pushing screw is provided on the rotating base and arranged in a center of the rotating base, and the pushing screw is snap-fastened with the base through an arc rising bar. This type of rotary bottle cannot be reused after use, causing environmental pollution.

SUMMARY

The object of this invention is to provide a rotary bottle with a replaceable inner container, in which the inner container can be separately separated from the outer bottle, and the inner container can be removed after using with a reusing function of an outer bottle remained, so as to reduce pollution to the environment, optimize a structure of the product, and reduce loss in a component.

In order to achieve the above object, the invention provides the following technical scheme:

The invention provides a rotary bottle with a replaceable inner container, which includes an outer bottle, an inner container and a rotating base, wherein an upper cover is removablely attached above the outer bottle, a rotating base is rotatably attached below the outer bottle, the inner container is coaxially installed at an inner of the outer bottle, an inner cover is installed above the inner container, a clamping point protruding outwards is provided at an outer wall of the inner container, and the clamping point is correspondingly clamped in a groove at an inner wall of the outer bottle. A screw is provide in an inner of the inner container, an upper clamping ring connected with the inner container is provide in a position, close to a circumferential edge, of an upper surface of a bottom of the screw, the upper clamping ring is clamped in an annular groove in an inner wall of the inner container, a bottom plug is installed in a position between a lower surface of the bottom of the screw and the rotating base, the bottom plug is clamped on a lower clamping ring in a position, close to the circumferential edge, of the lower surface of the bottom of the screw, and a circular boss is provided in a center position of the lower surface of the screw and is synchronously rotatably connected with the rotating base.

Preferably, an external thread is arranged on the upper outer wall of the outer bottle, and the upper cover is connected to an external thread of the outer bottle through threads.

Preferably, the inner cover is buckled above the inner container.

Preferably, the screw is threaded with a threaded sleeve, and the outer wall of the threaded sleeve is tightly attached to the inner wall of the inner container.

Preferably, an annular raised portion is provided above an outer diameter of the rotating base, and the raised portion is buckled in an annular groove in the inner wall position below the outer bottle.

Preferably, the center of the rotating base is provided with a rotation stopper hole, and a keyway is defined at an inner wall of the rotation stopper hole along an axial direction thereof, and the keyway is matched and connected with a rectangular bulge at the outer wall of the circular boss below the screw.

The invention has the beneficial effects that:

The invention presents a simple design structure and is convenient to use, in which the inner container can be separately designed from the outer bottle, and the inner container can be removed after use with a reusing function of an outer bottle remained, so as to reduce pollution to the environment, optimize a structure of the product, and reduce loss in a component.

BRIEF DESCRIPTION OF DRAWINGS

In order to more clearly explain the embodiment of the invention or the technical scheme in the prior art, the following will briefly introduce the drawings needed in the description of the embodiment or the prior art; obviously, the drawings in the following description are only some embodiments of the invention, and other drawings can be obtained by the ordinary skilled in the art according to these drawings without creative effort.

Figure 1:
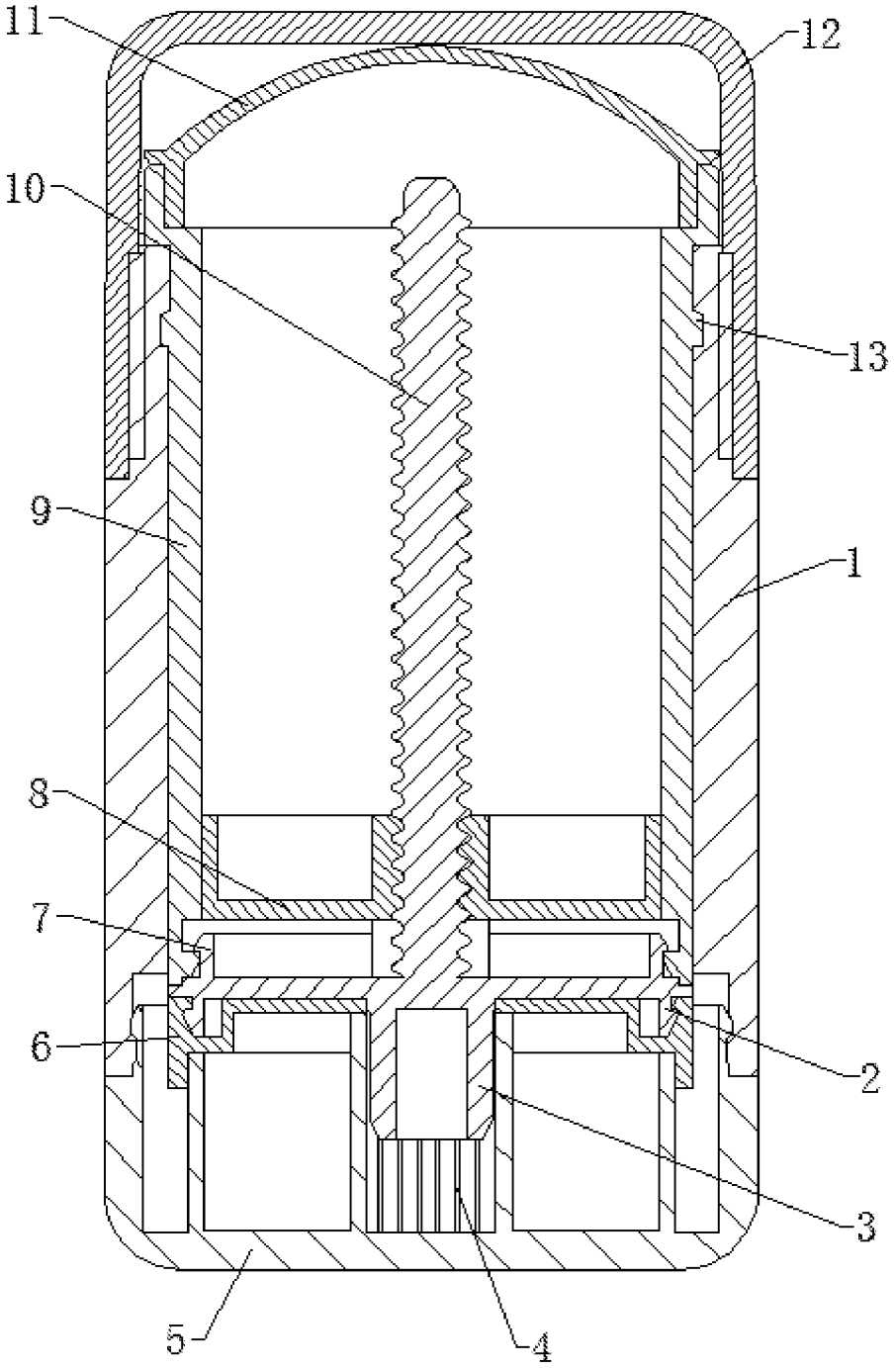
FIG. 1 is a cross-sectional view of a rotary bottle with a replaceable inner container in the invention.
Figure 2:
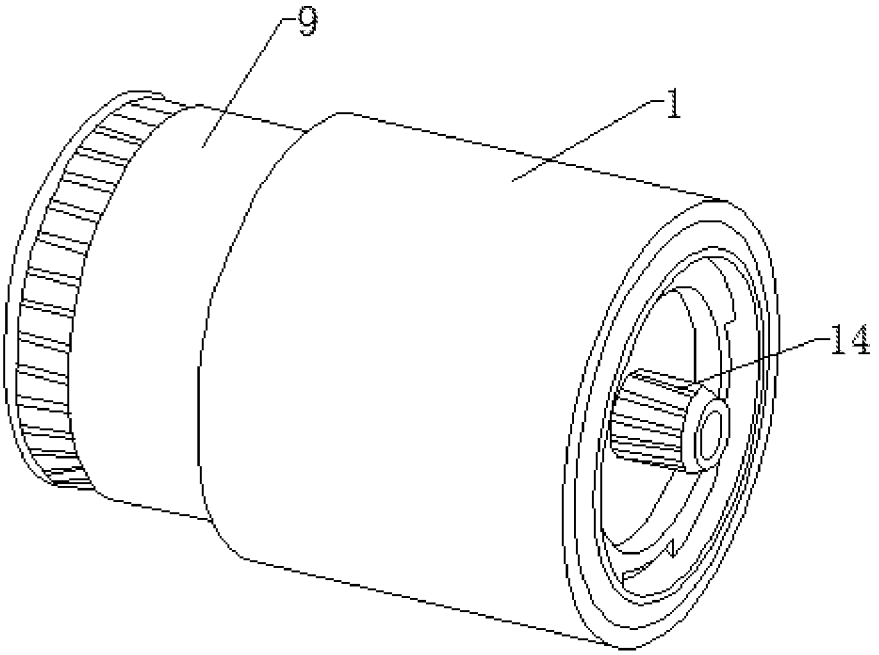
FIG. 2 is a partial perspective view of the rotary bottle in the invention.

Reference numerals are described as follows:

1. Outer bottle; 2. Lower clamping ring; 3. Circular boss; 4. Rotation stopper hole; 5, Rotating base; 6. Bottom plug; 7. Upper clamping ring; 8. Threaded sleeve; 9. Inner container; 10. Screw; 11. Inner cover; 12.

Upper cover; 13. Clamping point; 14. Rectangular bulge.

DETAILED DESCRIPTION OF THE PREFERRED EMBODIMENT

In order to make the purpose, technical scheme and advantages of the invention clearer, the technical scheme of the invention will be described in detail in the following. Obviously, the described embodiments are only a part of the embodiments of the invention, not all of them. On the basis of the embodiments of the invention, all other embodiments obtained by ordinary skilled in the art without creative labor fall in the scope protected by the invention.

As shown in the figures, the invention provides a rotary bottle with a replaceable inner container, which comprises an outer bottle 1, an inner container 9 and a rotating base, in which an upper cover 12 is removablely attached above the outer bottle 1, a rotating base 5 is rotatably attached below the outer bottle 1, and the inner container 9 is coaxially installed at an inner position of the outer bottle 1, an inner cover 11 is installed above the inner container 9, a clamping point 13 protruding outwards is arranged at a outer wall position of the inner container 9, and is correspondingly clamped in a groove at an inner wall of the outer bottle 1 so that the inner container 9 and the outer bottle 1 can be kept relatively stationary without effect of an external force, and the shaking between the inner container 9 and the outer bottle 1 can be avoided; a screw 10 is arranged in an inner position of the inner container 9, an upper clamping ring 7 connected with the inner container 9 is arranged in a position, close to a circumferential edge, of an upper surface of a bottom of the screw 10, the upper clamping ring 7 is clamped in an annular groove in an inner wall position of the inner container 9, and a bottom plug 6 is installed in a position between a lower surface of the bottom of the screw 10 and the rotating base 5, the bottom plug 6 is clamped on a lower clamping ring 2 in a position, close to the circumferential edge, of the lower surface of the bottom of the screw, and a circular boss 3 is provided in a center position of the lower surface of the screw 10 and is synchronously rotatably connected with the rotating base 5.

Specifically, an external thread is arranged on the upper outer wall of the outer bottle 1, and the upper cover 12 is connected to an external thread position of the outer bottle 1 through threads, so that the removable connection of the upper cover 12 can be realized in which the upper cover 12 can be removed when in use and it is convenient to use.

Specifically, the inner cover 11 is buckled above the inner container 9, and in use, the inner cover 11 can be detached by pulling the inner cover 11 upward.

Specifically, the screw 10 is threaded with a threaded sleeve 8, and the outer wall of the threaded sleeve 8 is tightly attached to the inner wall position of the inner container 9, so that the sealing effect can be realized and when the screw 10 rotates, the threaded sleeve 8 can move up and down along the axial direction thereof in the inner container 9.

Specifically, an annular raised portion is provided in a position above the outer diameter of the rotating base 5, and the raised portion is buckled in an annular groove at the inner wall position below the outer bottle 1, so that a relative rotation between the rotating base 5 and the outer bottle 1 can be realized, and the both are kept relatively stationary in the axial direction during the rotation.

Specifically, the center position of the rotating base 5 is provided with a rotation stopper hole 4, and a keyway is defined at the inner wall of the rotation stopper hole 4 along an axial direction thereof, and the keyway is matched and connected with a rectangular bulge 14 at the outer wall of the circular boss 3 below the screw 10, so that when the rotating base 5 and the outer bottle 1 are relatively rotated, the rotating base 5 can drive the screw 10 to rotate, and the screw 10 drives the threaded sleeve 8 to move up or down along the axis of the inner container 9 while rotating.

Working principle: a cosmetic paste (e.g. deodorant paste, facial cleanser, etc.) is placed inside the inner container 9, and when in use, the upper cover 12 is opened, the inner cover 11 is opened, and the rotating base 5 is rotated to drive the screw 10 to rotate, and the screw 10 drives the threaded sleeve 8 connected therewith to move upwards while rotating, thus pressing the paste inside the inner container 9 to move upwards; then users can use the paste to make up, and when the paste inside the inner container 9 is used up, the inner container 9 can be detached and replaced with a new inner container 9, after which the outer bottle 1 and the rotating base 5 can be reused, so as to achieve the purpose of recycling, reduce the pollution to the environment, optimize the product structure and reduce loss in a component.

Figure 3:
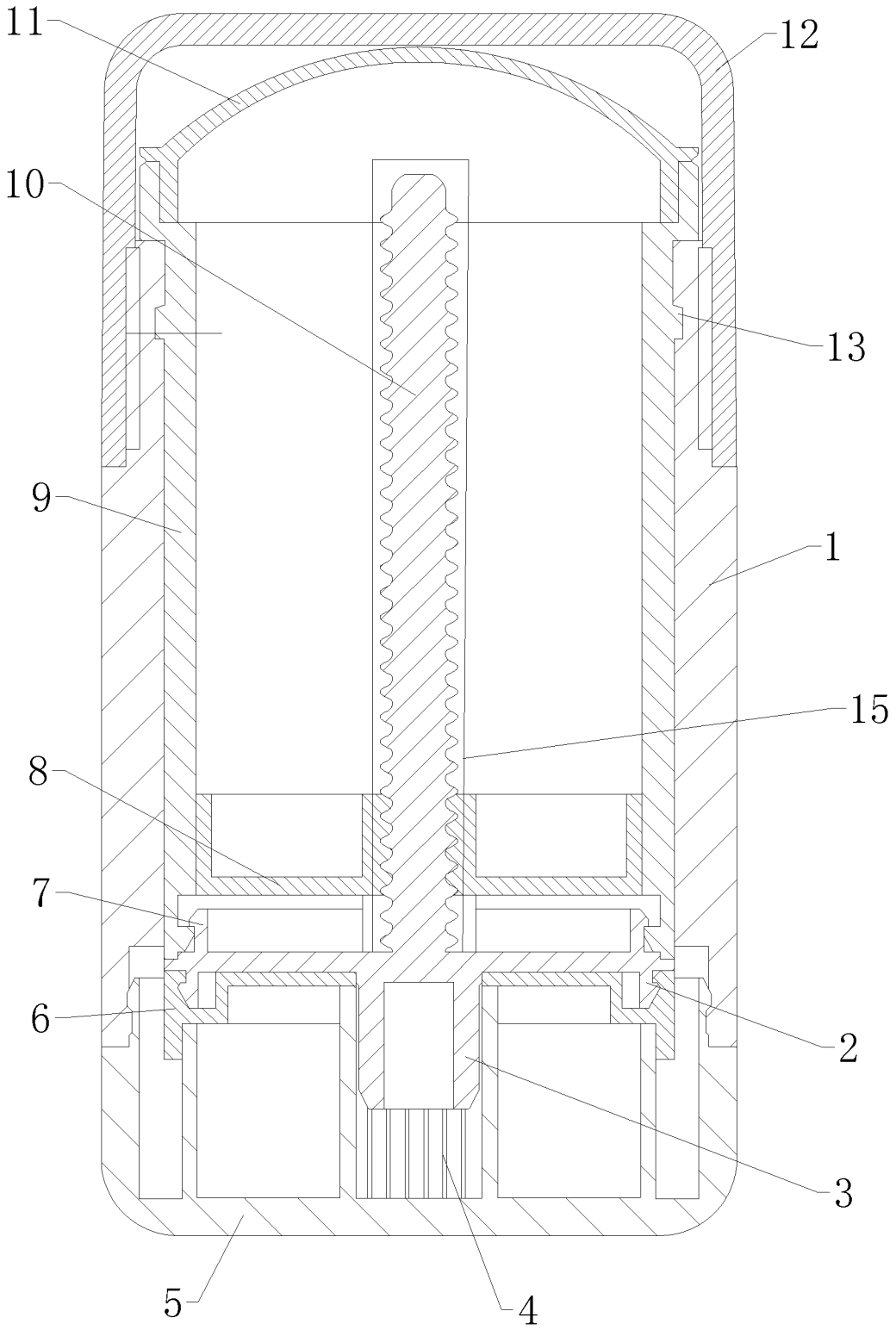
FIG. 3 is a partial perspective view of the rotary bottle in the invention of another embodiment.
Figure 4:
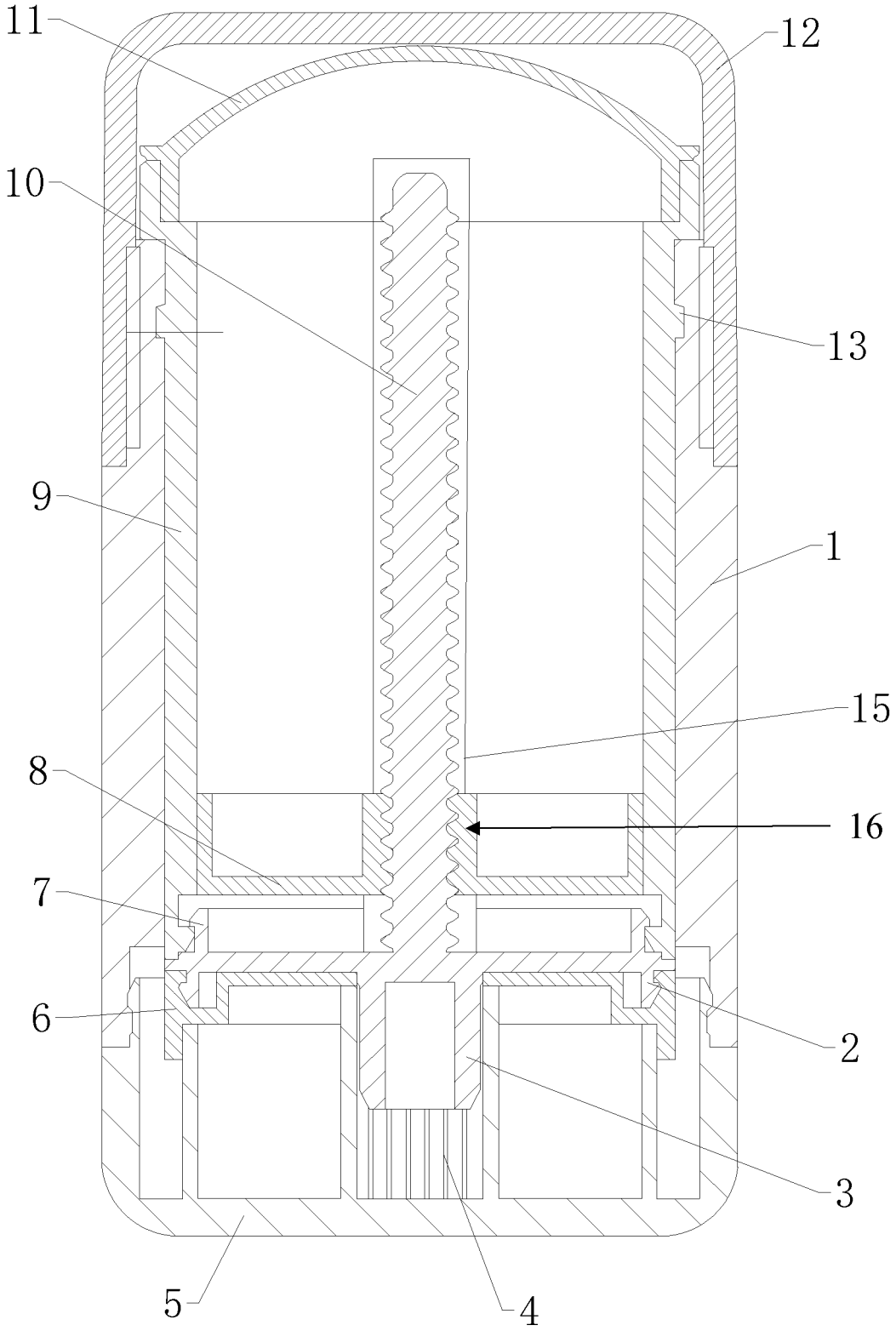
FIG. 4 is a partial perspective view of the rotary bottle in the invention of another embodiment.
Figure 5:
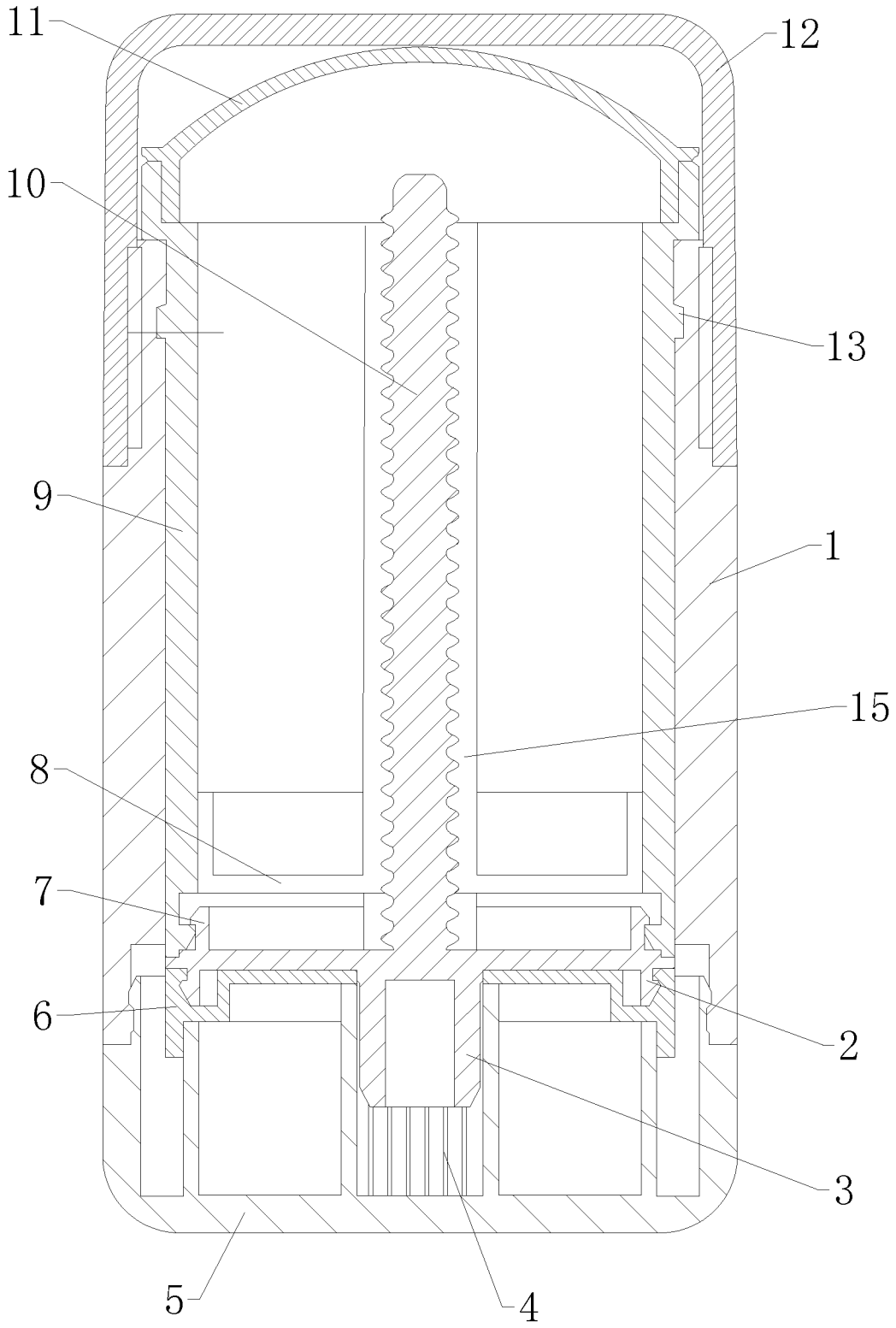
FIG. 5 is a partial perspective view of the rotary bottle in the invention of another embodiment.

In the other embodiment, as shown in FIG. 3, a tubular shaped wall 15 is set around the screw, one end of the tubular shaped wall 15 is fixedly connected to the lower clamping ring, and a channel is set within the threaded sleeve 8 to accommodate the tubular shaped wall 15 so that the tubular shaped wall 15 and threaded sleeve 8 are rotatably connected. With this setting, the cosmetic past in inner container 9 will not come into direct contact with the tubular shaped wall, thus reducing the waste of cosmetic past. Alternatively, the end of the tubular shaped wall can be fixedly connected to a middle part 16 of the threaded sleeve 8 as shown in FIG. 4. Alternatively, a middle part of the threaded sleeve 8 can be extended upward to a top of the screw as shown in FIG. 5.

The above is only specific embodiments of the invention, but the protection scope of the invention is not limited to this; changes or substitutions can be easily contemplated by any person familiar with the art within the technical scope disclosed by the invention, and should be covered within the protection scope of the invention. Therefore, the protection scope of the invention shall be subject to that of the claims.

The invention claimed is:

1. A rotary bottle with replaceable inner container, comprising:

an outer bottle, wherein an upper cover is removably attached above the outer bottle;

an inner container, wherein the inner container is coaxially installed at an inner of the outer bottle, an inner cover is installed above the inner container;

a rotating base, wherein the rotating base is rotatably attached below the outer bottle;

a screw, wherein the screw is provided in the inner of the inner container, an upper clamping ring connected with the inner container is provided in a position, close to a circumferential edge, of an upper surface of a bottom of the screw, the upper clamping ring is clamped in an annular groove at an inner wall of the inner container and a circular boss is provided at a center of the lower surface of the screw and is synchronously rotatably connected with the rotating base; and a bottom plug, wherein the bottom plug is installed in a position between a lower surface of the bottom of the screw and the rotating base, the bottom plug is clamped on a lower clamping ring in a position, close to the circumferential edge, of the lower surface of the bottom of the screw;

wherein a clamping point protruding outwards is provided at an outer wall of the inner container, and the clamping point is correspondingly clamped in a groove at an inner wall of the outer bottle so that the inner container and the outer bottle can be kept relatively stationary without an effect of an external force.

2. The rotary bottle with replaceable inner container according to claim 1, wherein an external thread is arranged on the upper outer wall of the outer bottle, and the upper cover is connected to an external thread of the outer bottle through threads.

3. The rotary bottle with replaceable inner container according to claim 1, wherein the inner cover is buckled above the inner container.

4. The rotary bottle with replaceable inner container according to claim 1, wherein the screw is threaded with a threaded sleeve, and the outer wall of the threaded sleeve is tightly attached to the inner wall of the inner container.

5. The rotary bottle with replaceable inner container according to claim 1, wherein an annular raised portion is provided above an outer diameter of the rotating base, and the raised portion is buckled in an annular groove at the inner wall below the outer bottle.

6. The rotary bottle with replaceable inner container according to claim 1, wherein a center of the rotating base is provided with a rotation stopper hole, and a keyway is defined at the inner wall of the rotation stopper hole along an axial direction thereof, and the keyway is matched and connected with a rectangular bulge at the outer wall of the circular boss below the screw.

7. The rotary bottle with replaceable inner container according to claim 4, wherein a tubular shaped wall is set around the screw, one end of the tubular shaped wall is fixedly connected to the lower clamping ring, and a channel is set within the threaded sleeve, the end of the tubular shaped wall extend from the lower clamping ring and go through the channel to make the tubular shaped wall and threaded sleeve rotatably connected, so that a cosmetic past filled in inner container will not come into direct contact with the tubular shaped wall.

8. The rotary bottle with replaceable inner container according to claim 4, wherein a tubular shaped wall is set around the screw, one end of the tubular shaped wall is fixedly connected to a middle part of the threaded sleeve so that a cosmetic past filled in inner container will not come into direct contact with the tubular shaped wall.

9. The rotary bottle with replaceable inner container according to claim 4, wherein a tubular shaped wall is set around the screw, a middle part of the threaded sleeve is extended upward to a top of the screw to form the tubular shaped wall, so that a cosmetic past filled in inner container will not come into direct contact with the tubular shaped wall.

* * * * *